US011384641B2

(12) United States Patent
Chakrabarti et al.

(10) Patent No.: US 11,384,641 B2
(45) Date of Patent: Jul. 12, 2022

(54) DISTRIBUTED HYBRID DAMPING SYSTEM

(71) Applicant: GENERAL ELECTRIC COMPANY, Schenectady, NY (US)

(72) Inventors: Suryarghya Chakrabarti, Niskayuna, NY (US); Bugra Han Ertas, Niskayuna, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 17/297,041

(22) PCT Filed: Dec. 11, 2018

(86) PCT No.: PCT/US2018/065051
§ 371 (c)(1),
(2) Date: May 26, 2021

(87) PCT Pub. No.: WO2020/122885
PCT Pub. Date: Jun. 18, 2020

(65) Prior Publication Data

US 2022/0025772 A1 Jan. 27, 2022

(51) Int. Cl.

| | |
|---|---|
| ***F01D 5/16*** | (2006.01) |
| ***F01D 5/18*** | (2006.01) |
| ***F01D 5/26*** | (2006.01) |
| ***F01D 25/00*** | (2006.01) |

(52) U.S. Cl.
CPC ..... *F01D 5/16* (2013.01); *F01D 5/18* (2013.01); *F01D 5/26* (2013.01); *F01D 25/005* (2013.01); *F05D 2250/241* (2013.01); *F05D 2260/96* (2013.01); *F05D 2300/175* (2013.01)

(58) Field of Classification Search
None
See application file for complete search history.

(56) References Cited

U.S. PATENT DOCUMENTS

| | | | | |
|---|---|---|---|---|
| 5,219,144 | A | 6/1993 | Fox et al. | |
| 5,232,344 | A * | 8/1993 | El-Aini | F01D 5/16 416/500 |
| 7,431,504 | B1 * | 10/2008 | Pelfrey | F16F 15/0237 384/535 |
| 9,334,740 | B2 * | 5/2016 | Kellerer | F01D 5/16 |
| 10,021,779 | B1 * | 7/2018 | Hart | H05K 1/0271 |
| 10,570,752 | B2 * | 2/2020 | Roesele | F04D 29/668 |
| 2013/0058785 | A1 * | 3/2013 | Kellerer | F01D 5/16 416/1 |
| 2017/0321557 | A1 * | 11/2017 | Roesele | F04D 29/668 |

FOREIGN PATENT DOCUMENTS

| | | |
|---|---|---|
| JP | 2015-148287 A | 8/2015 |
| JP | 2018-135803 A | 8/2018 |

* cited by examiner

*Primary Examiner* — Courtney D Heinle
*Assistant Examiner* — Jason Fountain
(74) *Attorney, Agent, or Firm* — McNees Wallace & Nurick LLC

(57) ABSTRACT

A turbine blade includes an internal vibration damping system having a plurality of unit cells. Each unit cell includes: an impacting structure; and a cavity encapsulating the impacting structure. The cavity, which includes a first hemisphere and a second hemisphere, is disposed within a substrate, which forms an outer casing of the cavity. At least one fluid is disposed in each of the first and second hemispheres between the impacting structure and the outer casing.

20 Claims, 3 Drawing Sheets

DISTRIBUTED HYBRID DAMPING SYSTEM

BACKGROUND

The present subject matter relates generally to systems and mechanisms for vibration damping, and more specifically to dual mode vibration damping systems.

Large industrial gas turbine (IGT) blades are exposed to unsteady aerodynamic loading which causes the blades to vibrate. If these vibrations are not adequately damped, they may cause high cycle fatigue and premature blade failure. The last-stage blade (LSB) is the tallest and therefore is the most vibrationally challenged component of the turbine. Conventional vibration damping methods for turbine blades include platform dampers, damping wires, and shrouds.

Platform dampers sit underneath the blade platform and are effective for medium and long shank blades, which have motion at the blade platform. IGT aft-stage blades have short shanks to reduce the weight of the blade and in turn reduce the pull load on the rotor which renders platform dampers ineffective.

IGT LSBs are often damped primarily via shrouds. Shrouds can be at the blade tip (tip-shroud) or at a partial span between the hub and tip (part-span shroud). Partial span and tip shrouds contact adjacent blades and provide damping when they rub against each other. Shrouds also provide an efficient way to tune or adjust the blade natural frequencies.

While shrouds provide damping and stiffness to the airfoil, they make the blade heavier, which in turn increases the pull load on the rotor, thereby increasing the weight and cost of the rotor. Thus light-weight solutions for aft-stage blades are attractive and may drive increases in the overall power output of the machine. Shrouds may also create aero performance debits. Tip-shrouds need a large tip fillet to reduce stress concentrations, which creates tip losses. Part-span shrouds create an additional blockage in the flow path and reduce aerodynamic efficiency. Lastly, it has been shown that tip shrouds induce significant twist in the vibration mode shapes of the blade causing high aeroelastic flutter instability.

BRIEF DESCRIPTION OF THE EMBODIMENTS

Aspects of the present embodiments are summarized below. These embodiments are not intended to limit the scope of the present claimed embodiments, but rather, these embodiments are intended only to provide a brief summary of possible forms of the embodiments. Furthermore, the embodiments may encompass a variety of forms that may be similar to or different from the embodiments set forth below, commensurate with the scope of the claims.

In one aspect, a unit cell 26 for use in a damping system 24 includes: an impacting structure 34; a cavity 32 encapsulating the impacting structure 34, the cavity 32 including a first hemisphere 32A and a second hemisphere 32B, the cavity 32 disposed within a substrate 28, the substrate 28 forming an outer casing of the cavity 32; and at least one fluid 36 disposed in each of the first and second hemispheres 32A, 32B between the impacting structure 34 and the outer casing 28.

In another aspect, a vibration damping system 24 includes: a plurality of unit cells 26, each unit cell 26 of the plurality of unit cells including: a substantially spherical impacting structure 34; a cavity 32 encapsulating the substantially spherical impacting structure 24, the cavity 32 comprising a first hemisphere 32A and a second hemisphere 32B, the cavity 32 disposed within a substrate 28, the substrate 28 forming an outer casing of the cavity; and at least one fluid 36 disposed in each of the first and second hemispheres 32A, 32B between the substantially spherical impacting structure 34 and the outer casing. The vibration damping system 24 dampens at least one vibration mode in the substrate 28.

In another aspect, a turbine blade includes: an internal vibration damping system 24 disposed within the turbine blade 10, the internal vibration damping system 24 including: a plurality of unit cells 26, each unit cell 26 including: an impacting structure 34; a cavity 32 encapsulating the impacting structure 34, the cavity 32 comprising a first hemisphere 32A and a second hemisphere 32B, the cavity 32 disposed within a substrate 28 of the turbine blade 10, the substrate 28 forming an outer casing of the cavity; and at least one fluid 36 disposed in each of the first and second hemispheres 32A, 32B between the impacting structure 34 and the outer casing. The vibration damping system 24 dampens at least one vibration mode in the turbine blade 10.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Figure 3:
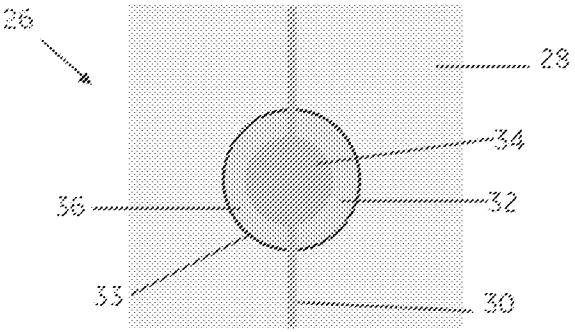
FIG. 3 is a side view schematic representation of a unit cell of an internal damping system.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "axial" refers to a direction aligned with a central axis or shaft of a gas turbine engine.

As used herein, the term "circumferential" refers to a direction or directions around (and tangential to) the outer circumference of the gas turbine engine, or for example the circle defined by the swept area of the rotor of the gas turbine engine. As used herein, the terms "circumferential" and "tangential" may be synonymous.

As used herein, the term "radial" refers to a direction moving outwardly away from the central axis of the gas turbine engine. A "radially inward" direction is aligned toward the central axis moving toward decreasing radii. A "radially outward" direction is aligned away from the central axis moving toward increasing radii.

The embodiments described herein include distributed vibration damping structures internal to large aft-stage industrial gas turbine blades, among other applicable components. These damper structures work on the principle of viscous damping for small vibration levels and impact damping for larger vibrations. If designed properly, these dampers can eliminate the need for turbine blade shrouds, significantly increasing the aft-stage $AN^2$ entitlement, as well as the power output of large industrial gas turbines, (where $AN^2$ is the flow path annulus area multiplied by the square of the rotor speed (RPM)).

Figure 1:
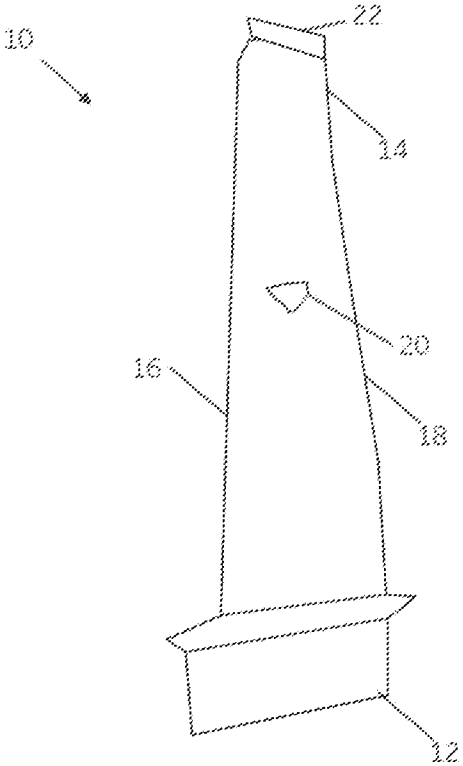
FIG. 1 is a side schematic representation of a turbine blade with mid-span shrouds and tip shrouds.

FIG. 1 illustrates an exemplary turbine blade 10, extending from a root portion 12 to a tip portion 14, and from a leading edge 16 to a trialing edge 18. The turbine blade illustrated in FIG. 1 also includes a partial span shroud 20 and a tip shroud 22.

Figure 2:
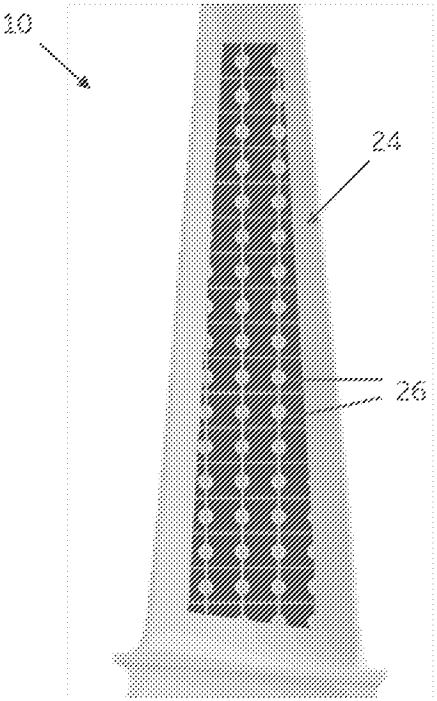
FIG. 2 is a side schematic representation of a turbine blade with an internal damping system.

FIG. 2 illustrates a turbine blade 10 according to the embodiments disclosed herein including an internal damping system 24 that includes a plurality of unit cells 26. The embodiment of FIG. 2 utilizes the internal damping system 24 rather than the partial span shrouds 20 and/or tip shrouds 22 of FIG. 1. A unit cell 26 of this damping system 24 may be connected in a matrix and/or array with adjacent unit cells 26 extending radially, circumferentially, and/or axially throughout the turbine blade 10. The matrix and/or array of unit cells 26 making up the damping system 24 may be uniform throughout the turbine blade 10, or may be non-uniform in order to allow the matrix and/or unit cells 26 to be adjusted as needed to address different vibrational characteristics at different portions of the turbine blade 10.

FIG. 3 illustrates an individual unit cell 26 which may include an outer casing 28 with a cavity 32 filled with a fluid 36 and a diaphragm 30 coupled to an impacting structure 34, which may be ball-shaped, substantially spherical, and/or other suitable shapes, such as, for example, an ellipsoid. The diaphragm 30 and impacting structure 34 may both be metallic and/or other suitable materials with the desired mass and/or material properties. Cavity 32 may be substantially spherical. The diaphragm 30 and the impacting structure 34 may be designed such that the natural frequency of the impacting structure-diaphragm assembly matches a natural frequency of the component (i.e., turbine blade 10, for example) to be damped. Under small vibrations the impacting structure 34 sloshes in the fluid 36 creating viscous drag on the impacting structure 34. Under larger vibrations, the impacting structure 34 may impact the outer casing 28 (i.e., at the boundary with the diaphragm 32) creating impact damping. An array of these unit cell dampers 26 may be used to provide distributed damping to a structure or component (i.e., turbine blade 10, for example). For structures where multiple vibratory modes may require damping, damping system 24 including different groups of unit cells 26 may be arranged targeting each mode separately.

The unit cell 26 may also include a bladder 33 disposed within the outer casing 28. The bladder 33 may be used to hold the fluid 36. The bladder 33 may be composed of metallic material and/or other materials that are sufficiently thermally resistant and provide the desired material properties. The bladder 33 may be welded, brazed, epoxied, adhered and/or otherwise attached to the interior surface of the outer casing 28. The bladder 33 may also be attached (via weld, braze, epoxy, and/or other attachment means) to the diaphragm 30. The bladder 33 may also include one or more holes and/or slots to allow the diaphragm 30 to be disposed therethrough. In embodiments that include holes and/or slots disposed in the bladder 33, sealant and/or sealing features may be disposed at any interfaces between the bladder 33 and the diaphragm 30 to prevent fluid 36 from exiting the bladder 33. The sealing features may also be used to fill the bladder 33 with fluid 36. For example, a threaded plug may be disposed at the interface between the bladder 33 and diaphragm 30. After the diaphragm 30 is disposed between a hole or slot within the bladder 33, the bladder 33 may be filled with fluid 36, prior to the plug being secured into the bladder 33 at the interface with the diaphragm 30. In other embodiments, a bladder 33 may not be required because voids in the outer casing 28 in which unit cell 26 is disposed may be dimensioned such that they provide sufficient sealing to ensure the fluid 36 remains within the cavity 32.

Figure 4:
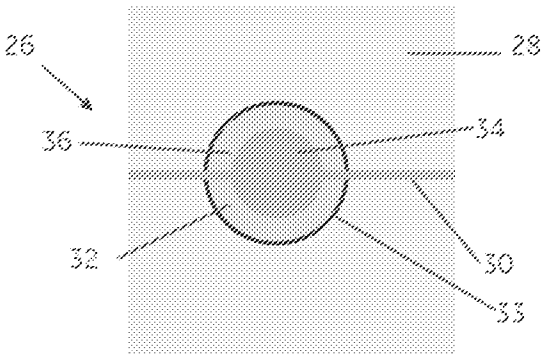
FIG. 4 is a side view schematic representation of a unit cell of an internal damping system.

FIG. 4 illustrates an individual unit cell 26 including the diaphragm 30, cavity 32, impacting structure 34, and fluid 36 surrounded by the outer casing 28. The embodiment of FIG. 4 is oriented such that the diaphragm 30 and other features are orthogonal to corresponding features of FIG. 3. As discussed above and below, each of the unit cells 26 and arrays thereof may be arranged and/or oriented so as to address the vibrational requirements of a specific component (i.e., turbine blade 10) and/or of a specific location of a component.

Figure 5:
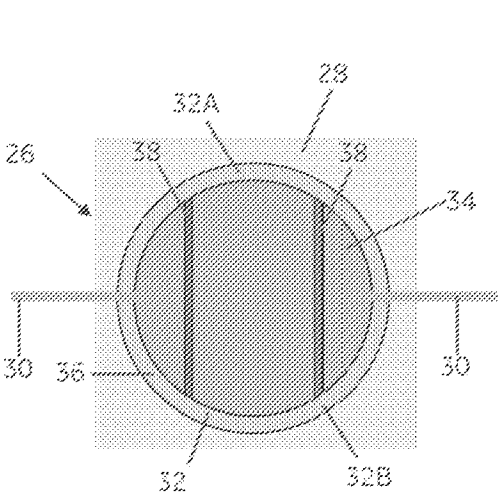
FIG. 5 is a side view schematic representation of a unit cell of an internal damping system.

FIG. 5 illustrates an individual unit cell 26 including the diaphragm 30, cavity 32, impacting structure 34, and fluid 36 surrounded by the outer casing 28. The embodiment of FIG. 5 includes first and second hemispheres 32A, 32B collectively forming the cavity 32. Stated otherwise, the unit cell 26 includes a cavity 32 that is divided into two separate portions: a first hemisphere 32A and a second hemisphere 32B. Each of the first and second hemispheres 32A, 32B is a separate chamber filled with fluid 36. The diaphragm 30 and impacting structure 34 collectively form a boundary between the first and second hemispheres 32A, 32B. As such, the diaphragm 30 forms a circumferential ring around the impacting structure 34 extending from the surface of the impacting structure 34 radially outward to the casing 28.

Referring still to FIG. 5, the first and second hemispheres 32A, 32B, although separate, are fluidly connected via a plurality of fluid passages 38 disposed through the impacting structure 34. Fluid from the first hemisphere 32A may enter at least one of the plurality of fluid passages 38, and may flow therethrough into the second hemisphere 32B. When subjected to small levels of vibration, the impacting structure 34 moves from one side of the cavity 32 to the other side, forcing fluid 36 to flow from the first hemisphere 32A into the second hemisphere 32B or from the second hemisphere 32B to the first hemisphere 32A through one or more of the plurality of fluid passages 38. This fluid motion causes viscous drag in the fluid 36 creating viscous energy dissipation and damping. The fluid 36 may at least partially include gallium and/or other suitable fluids. Each of the plurality of fluid passages 38 may be substantially tubular and/or or cylindrical in shape and may have an outer diameter specifically selected to achieve a desired amount of fluid viscosity therethrough, based at least partially on the expected vibrations that the component may experience. Each of the plurality of fluid passages 38 may include an internal diameter (or minimum dimension for embodiments with non-circular fluid passage cross-sections) that is between about 2 and about 200 mils. In other embodiments, each of the plurality of fluid passages 38 may include an internal diameter or minimum dimension that is between about 3 and about 100 mils. In other embodiments, each of the plurality of fluid passages 38 may include an internal diameter or minimum dimension that is between about 4 and about 50 mils. In other embodiments, each of the plurality of fluid passages 38 may include an internal diameter or minimum dimension that is between about 5 and about 30 mils. In other embodiments, each of the plurality of fluid passages 38 may include an internal diameter or minimum dimension that is between about 6 and about 20 mils. In other embodiments, each of the plurality of fluid passages 38 may include an internal diameter or minimum dimension that is between about 8 and about 16 mils. In other embodiments, each of the plurality of fluid passages 38 may include an internal diameter or minimum dimension that is between about 10 and about 14 mils.

Figure 6:
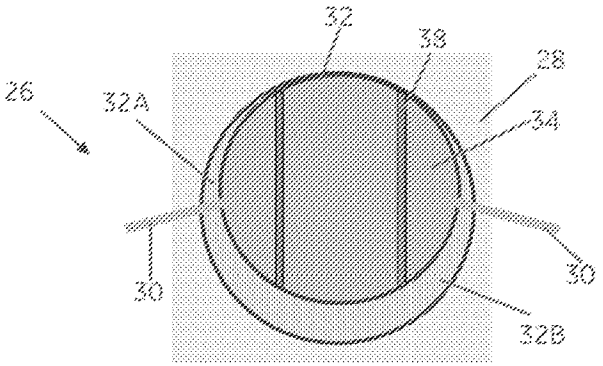
FIG. 6 is a side view schematic representation of a unit cell of an internal damping system.

FIG. 6 illustrates an individual unit cell 26 including the diaphragm 30, cavity 32, impacting structure 34, and fluid 36 surrounded by the outer casing 28. The embodiment of FIG. 6 illustrates a high vibration operating condition in which vibrations cause the impacting structure 34 (including the plurality of fluid passages 38 disposed therein) to translate within the cavity toward the first hemisphere 32A. The impacting structure 34 contacts an edge of the cavity 32 and/or the outer casing 28. In the embodiment of FIG. 6, the diaphragm 32 may flex due to the high vibrations, and due to the movement of the impacting structure 34 toward the first hemisphere 32A. As the impacting structure 34 moves toward and/or into the first hemisphere 32A, the fluid 36 travels through one or more of the plurality of fluid passages 38, causing viscous damping. When the impacting structure 34 contacts the outer casing 28, impact damping occurs, further causing vibrations in the component or structure to be absorbed and/or mitigated by the internal damping system 24.

Figure 7:
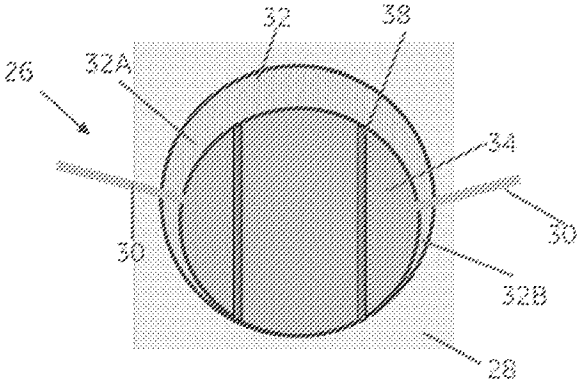
FIG. 7 is a side view schematic representation of a unit cell of an internal damping system.

FIG. 7 illustrates an individual unit cell 26 similar to the embodiment of FIG. 6. In the embodiment of FIG. 7, high vibrations cause movement of the impacting structure 34 toward and/or into the second hemisphere 32B, where the impacting structure 34 contacts the outer casing 28. In the embodiment of FIG. 7, the diaphragm may flex toward the second hemisphere 32B, due to the high vibrations and the movement of the impacting structure 34.

Figure 8:
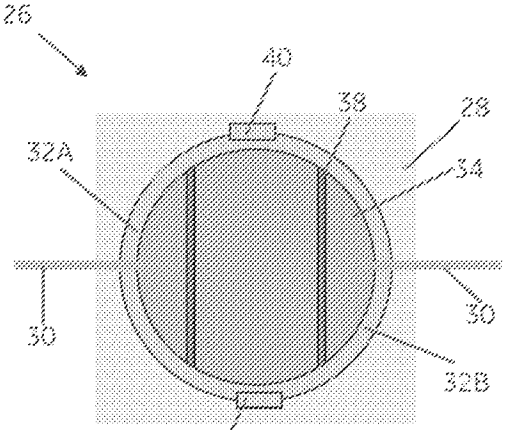
FIG. 8 is a side view schematic representation of a unit cell of an internal damping system.

FIG. 8 illustrates an individual unit cell 26 including the diaphragm 30, cavity 32, impacting structure 34, and fluid 36 surrounded by the outer casing 28. The embodiment of FIG. 8 includes a first stopper 40 disposed in the first hemisphere 32A and a second stopper 42 disposed in the second hemisphere 32B. Each of the first and second stoppers 40, 42 may serve to limit the range of motion of the impacting structure 34. According to the embodiments disclosed herein, it may be desirable to limit the range of movement of the impacting structure 34 in order to prevent damage and/or reduce the chance of damage to the impacting structure 34, the diaphragm 30, the plurality of fluid passages 38, and/or other features of the unit cell 26. In embodiments of the unit cell 26 that include at least one stopper 40, 42, the impacting structure 34 may contact the first and/or second stopper 40, 42 rather than the outer casing 28. Similar to the previous embodiments, the damping system 24 of FIG. 8 includes both viscous and impact damping as means for absorbing and/or damping vibrations within the structure or component (i.e., turbine blade 10). When subject to larger levels of vibration, the first and/or second stoppers 40, 42 may allow for better clearance definition and enhanced durability. Contact between the impacting structure 34 and the first and/or second stoppers 40, 42 enables a second damping mode (impact vibration damping) which complements the viscous damping from the motion of the fluid. Another use of the impacting structure 34 and stops 40, 42 is that they cause the displacement of the impacting structure 34 to remain below acceptable limits such that the diaphragm 30 does not get damaged from high vibratory stresses.

Figure 9:
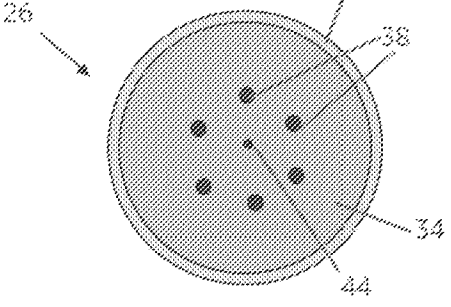
FIG. 9 is a top view schematic representation of a unit cell of an internal damping system.

FIG. 9 illustrates an individual unit cell 26 including the diaphragm 30, cavity 32, and impacting structure 34. Whereas the embodiments of FIGS. 5-8 may be described as side views of the unit cell 26, the embodiment of FIG. 9 may be described as a top view. FIG. 9 illustrates the plurality of fluid passages 38 disposed within the impacting structure 34. In the embodiment of FIG. 9, each fluid passage of the plurality of fluid passages 38 is disposed at approximately equal distances from a center axis 44 of the impacting structure 34. The embodiment of FIG. 9 includes 6 fluid passages 38 disposed within the impacting structure 34. In other arrangements of the embodiments disclosed herein, the impacting structure 34 may include a single fluid passage 38 disposed therein, as well as other numbers of fluid passages 38 including, for example, 2, 3, 4, 5, 7, 8 or more fluid passages 38.

Figure 10:
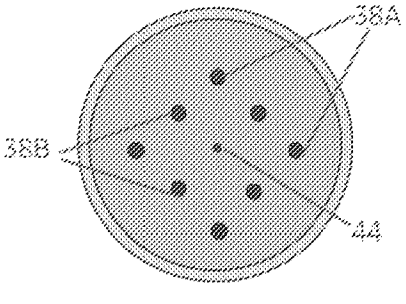
FIG. 10 is a top view schematic representation of a unit cell of an internal damping system.

FIG. 10 illustrates a top view of an individual unit cell 26 including the diaphragm 30, cavity 32, and impacting structure 34. In the embodiment of FIG. 10, the unit cell 26 includes a first plurality of fluid passages 38A disposed at a first radius (or distance) from the impacting structure center axis 44, as well as a second plurality of fluid passages 38B disposed at a second radius (or distance) from impacting structure center axis 44. The first radius (or distance) may be greater than the second radius (or distance).

Figure 11:
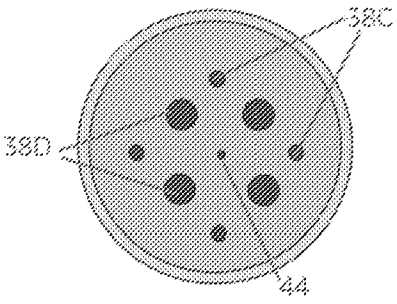
FIG. 11 is a top view schematic representation of a unit cell of an internal damping system.

FIG. 11 illustrates a top view of an individual unit cell 26 including the diaphragm 30, cavity 32, and impacting structure 34. In the embodiment of FIG. 11, the unit cell 26 includes a third plurality of fluid passages 38C including a first passage diameter, as well as a fourth plurality of fluid passages 38D including a second passage diameter. The first passage diameter may be smaller than the second passage diameter. The third and fourth pluralities of fluid passages 38C, 38D may also be disposed at different radii (or distances) from the center axis 44 of the impacting structure 34.

Each of the embodiments illustrated in FIGS. 9-11 include a diaphragm 30 (not shown) extending around the impacting structure 34 to the outer casing 28 (not shown), similar to the side views of FIGS. 3-8. Each of the embodiments disclosed herein may include configurations in which each of the plurality of fluid passages 38 may include bends, curves, angled portions (and/or entirely angled or non-parallel passages), as well as passages with non-uniform flow areas and/or cross sections. Each of the plurality of fluid passages 38 may also include different fluid passage inlet and outlet configurations which may include, for example wider inlets (i.e., bellmouths) and/or converging/diverging portions. The impacting structure 34 and plurality of fluid passages therethrough 38 may be manufactured via any suitable manufacturing process including via additive manufacturing and investment casting. In some embodiments, the impacting structure 34 and plurality of fluid passages therethrough 38 may be 3d-printed directly via additive manufacturing. In other embodiments, the impacting structure 34 may be cast and the plurality of fluid passages therethrough 38 may also be cast in during one or more investment casting processes. In other embodiments, the impacting structure 34 may be cast via investment vesting and/or 3d-printed via additive manufacturing while the plurality of fluid passages 38 may be drilled into the impacting structure 34 after the impacting structure 34 is formed. In other embodiments, the damping system 24 may be formed via additive manufacturing individually and then attached to and/or within the turbine blade 10. For example, the damping system 24 may be formed separately and then inserted into the turbine blade 10 at the tip portion 14. In other embodiments, the damping system 24 may be printed via additive manufacturing directly onto the turbine blade 10.

Figure 12:
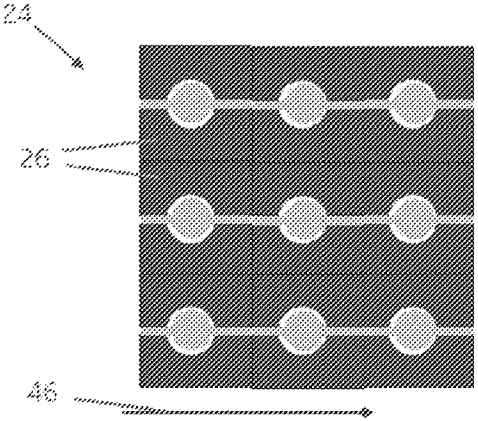
FIG. 12 is a side view schematic representation of an internal damping system.
Figure 13:
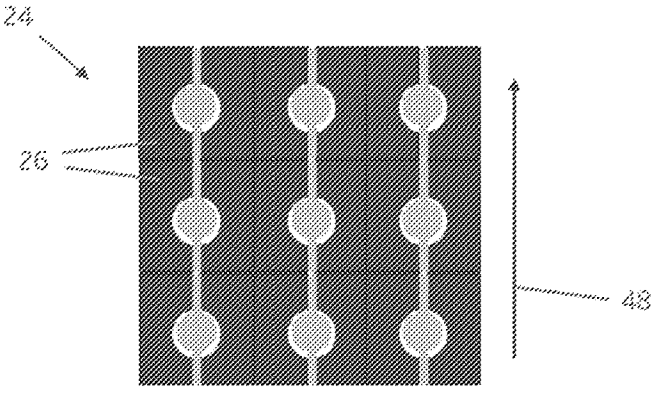
FIG. 13 is a side view schematic representation of an internal damping system.

FIG. 12 illustrates a damping system 24 including a plurality of unit cells 26 aligned such that the diaphragm of each unit cell 26 is coupled to the diaphragm of an adjacent unit cell 26 along a first direction 46. FIG. 13 illustrates a damping system 24 including a plurality of unit cells 26 aligned such that the diaphragm of each unit cell 26 is coupled to the diaphragm of an adjacent unit cell 26 along a second direction 48. Each of the damping systems 24 of FIGS. 12 and 13 may be used in separate components or within different portions of a single component or structure.

Figure 14:
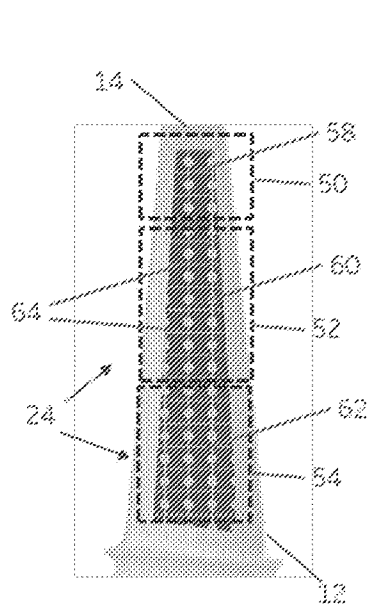
FIG. 14 is a side schematic representation of a turbine blade with at least one internal damping systems; according to aspects of the embodiments disclosed herein.

FIG. 14 illustrates a turbine blade 10 including one or more damping systems 24 disposed in different regions of the turbine blade. The turbine blade may include a first damping system 58 disposed at a first region 50, adjacent or proximate the tip portion 14. The first damping system 58 may be configured to damp vibrations resulting from a tip flex mode. The turbine blade 10 may include a second damping system 60 disposed within a second region 52 at a mid-span portion of the blade between the root portion 12 and the tip portion 14. The second damping system 60 may be configured to damp vibrations resulting from a second flex mode, the second flex mode being different than the tip flex mode. The turbine blade 10 may also include a third damping system 62 disposed within a third region 54 adjacent or proximate the root portion 12. The third damping system 62 may be configured to damp vibrations resulting from a third flex mode. The third flex mode may be a higher order flex mode (i.e., corresponding to higher frequency vibrations) than each of the first and second flex modes. The damping system 24 may also include a support grid 64 with individual structural members of the support grid 64 structurally coupled to the diaphragms 30, helping to hold the damping system 24 together. In one embodiment, the damping system 24 may include structural members of the support grid 64 aligned in a first direction, and the diaphragms 30 aligned in a second direction, the second direction being substantially orthogonal to the first direction.

The embodiments disclosed herein may be formed via various processes. In embodiments that include the bladder 33, the damping system 24, including the diaphragms 30, impacting structure 32, and bladder 33 may be formed separately and then attached (for example, via weld, epoxy, braze, adhesive, and/or other suitable process to an interior surface of a first half of the turbine blade 10. A second half of the turbine blade may then be secured to the first half of the turbine blade 12, thereby encapsulating the damping system 24 within the turbine blade. The cavity 32 and/or bladder 33 may then be filled with fluid 36 via fill passages disposed within the diaphragms 30, the fill passages being in fluid communication with the cavity 32. The fill passages may be fluidly coupled to a fluid inlet at one end, and a fluid exit at another end. The fluid exit may be used to remove any air or other gases from the fill passages during the fluid fill process. In other embodiments, each of the cavities 32 and/or bladders 33 may be filled via one or more plugs (described above) prior to the damping system being disposed into the interior of the turbine blade 10. Cavities may also be cast into the blade in the form of one or more cores. Pre-assembled damper cells (with fluid) can then be inserted in these cavities with an appropriate locking mechanism. In other embodiments, additive manufacturing may be used to print these dampers directly inside the cavities of cast blades with connected fluid chambers, then subsequently filling with fluid after printing.

Although this disclosure is primary directed towards turbine blade applications, damping technology and embodiments disclosed herein may be applied to other vibrating components in gas turbines or other machinery where conventional external dampers are not feasible (or not preferred).

A unit cell 26 may be designed such that the first natural frequency of the vibrating structure targets a specific natural frequency of the turbine blade 10 to be damped. In this way, different sizes of damper unit cells 26 may be included in the damping system 24 to target all modes of interest. The unit cells 26 may also be placed optimally to get the desired damping on all modes. For example, cells targeting tip flex modes may be placed near the tip portion 14 of the turbine blade 10, cells targeting second flex modes may be placed in the middle spans of the turbine blade 10, and cells targeting higher order modes may be placed adjacent the root portion 12 and/or at other locations. Each of the diaphragms 30 may be at least partially composed of Inconel 738, Inconel 625, and/or other suitable nickel-based superalloys with 1000° F. temperature capability, as well as equivalent coefficients of thermal expansion. In one embodiment, the material of the diaphragm is selected such that it substantially matches the coefficient of thermal expansion of the substrate material (i.e., the material of the outer casting 28 and/or turbine blade 10). Each of the stoppers 40, 42 may be composed of the same material as the diaphragm, and each may include an impact resistant coating and/or wear coating. In addition, each of the impacting surfaces (i.e., impact structure 34, stoppers 40, 42, portions of the bladder 33, and/or impacting portions of the outer casing 28) may include materially hardened surfaces.

In one aspect of the embodiments disclosed herein, powder may be used instead of fluid and/or liquid gallium.

Liquid gallium may provide enhanced temperature capabilities compared to other fluids in applications where temperature resistance is desired (for example, applications that include turbine blades 10, and/or other high-temperature components). Other possible fluids 36 may include liquid silicon, mercury, air, steam, air-steam mixtures, and/or other suitable fluids. In other embodiments, one or more friction damper mechanisms may be used instead of viscous damping. By adjusting the size of the impacting structure 34, the number, size and shape of the one or more fluid passages 38, the orientation of damping system 24, the placement of the damping system 24 on the component or structure, and the use, dimensions, and/or placement of the stoppers 40, 42, the damping systems 24 of the embodiments disclosed herein may be used to address multiple vibrational modes in multiple locations of a structure or component, including one or more turbine blades 10. The natural frequency of each impacting structure 34 and/or unit cell 26 may be selected (i.e., by adjusting the diameter thereof and/or other dimensions) such that it matches the natural frequency of the turbine blade 10, thereby providing enhanced vibrational damping.

Exemplary applications of the present embodiments may include steam turbine blades, gas turbine blades, rotary engine blades and components, compressor blades and impellers, combustor modules, combustor liners, exhaust nozzle panels, aircraft control surfaces, reciprocating engine components, air-cooled condenser fan blades, bridges, aircraft engine fan blades, structures and surfaces of aircraft, structures and surfaces of automobiles, structures and surfaces of locomotives, structures, components and surfaces of machinery, and/or other components in which there is a desire to damp vibrations.

Although specific features of various embodiments of the present disclosure may be shown in some drawings and not in others, this is for convenience only. In accordance with the principles of the present disclosure, any feature of a drawing may be referenced and/or claimed in combination with any feature of any other drawing.

This written description uses examples to disclose the embodiments of the present disclosure, including the best mode, and also to enable any person skilled in the art to practice the disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A turbine blade, comprising:

a plurality of internal vibration damping systems disposed within the turbine blade, each of the plurality of internal vibration damping systems comprising:

a plurality of unit cells, each unit cell of the plurality of unit cells comprising:

an impacting structure;

a cavity encapsulating the impacting structure, the cavity comprising a first hemisphere and a second hemisphere, the cavity disposed within a substrate of the turbine blade, the substrate forming an outer casing of the cavity; and at least one fluid disposed in each of the first hemisphere and the second hemisphere between the impacting structure and the outer casing, wherein each of the plurality of internal vibration damping systems dampens at least one vibration mode in the turbine blade, and wherein the plurality of internal dampening systems includes:

a first damping system disposed within a first region adjacent a tip portion of the turbine blade to dampen a tip vibratory mode; and a second damping system disposed within a second region adjacent a mid-span of the turbine blade to dampen a second vibratory mode of the turbine blade, wherein the first and second damping systems dampen different vibratory modes of the turbine blade.

2. The turbine blade of claim 1, wherein the plurality of internal vibration damping systems further comprises a third damping system disposed within a third region adjacent a root portion of the turbine blade to dampen a third vibratory mode of the turbine blade and the third vibratory mode is higher frequency than each of the second vibratory mode and the tip vibratory mode.

3. The turbine blade of claim 1, wherein the at least one fluid at least partially comprises at least one of liquid gallium, liquid silicon, mercury, air, steam, and an air-steam mixture.

4. The turbine blade of claim 1, wherein a movement of the at least one fluid within the cavity causes viscous damping of the at least one vibration mode within the turbine blade.

5. The turbine blade of claim 1, wherein an impact of the impacting structure against the outer casing causes impact damping of the at least one vibration mode within the turbine blade and wherein the cavity is substantially spherical.

6. The turbine blade of claim 1, wherein:

the impacting structure is substantially spherical; and at least one diaphragm extends from an exterior surface of the impacting structure to the outer casing, the at least one diaphragm fluidly separating the first hemisphere and the second hemisphere.

7. The turbine blade of claim 6, wherein each of the plurality of internal vibration damping systems further comprises a support grid, the support grid comprising at least one structural member, the at least one structural member coupling a first diaphragm of the at least one diaphragm of a first unit cell to a second diaphragm of the at least one diaphragm of a second unit cell, wherein the plurality of unit cells includes the first unit cell and the second unit cell.

8. The turbine blade of claim 7, wherein the at least one structural member is oriented substantially orthogonally to at least one of the first diaphragm and the second diaphragm.

9. The turbine blade of claim 6, wherein the at least one diaphragm at least partially comprises at least one nickel-based superalloy.

10. The turbine blade of claim 1, further comprising at least one fluid passage disposed in the impacting structure, wherein:

the at least one fluid passage fluidly connects the first hemisphere and the second hemisphere; and movement of the at least one fluid through the at least one fluid passage causes viscous damping of the at least one vibration mode within the turbine blade.

11. The turbine blade of claim 10, wherein the at least one fluid passage further comprises multiple passages, and wherein:

a first passage of the multiple passages is disposed at a different distance from a center axis of the impacting structure than a second passage of the multiple passages; or the first passage of the multiple passages comprises a different internal flow area than a second passage of the multiple passages.

12. The turbine blade of claim 1, further comprising at least one stopper disposed within at least one of the first hemisphere and the second hemisphere, wherein:

the at least one stopper is coupled to the outer casing; and the at least one stopper limits a range of motion of the impacting structure within the cavity.

13. The turbine blade of claim 1, wherein:

the impacting structure is substantially spherical;

each unit cell further comprises:

at least one diaphragm extending from an exterior surface of the substantially spherical impacting structure to the outer casing, the at least one diaphragm fluidly separating the first hemisphere and the second hemisphere; and at least one fluid passage disposed in the substantially spherical impacting structure, the at least one fluid passage fluidly connecting the first hemisphere and the second hemisphere;

the at least one fluid at least partially comprises at least one of liquid gallium, liquid silicon, mercury, air, steam, and an air-steam mixture; and the at least one diaphragm comprises at least one nickel-based superalloy.

14. A turbine blade, comprising:

an internal vibration damping system disposed within the turbine blade, the internal vibration damping system comprising:

a plurality of unit cells, each unit cell of the plurality of unit cells comprising:

an impacting structure;

a cavity encapsulating the impacting structure, the cavity comprising a first hemisphere and a second hemisphere, the cavity disposed within a substrate of the turbine blade, the substrate forming an outer casing of the cavity; and at least one fluid disposed in each of the first hemisphere and the second hemisphere between the impacting structure and the outer casing, wherein:

the internal vibration damping system dampens at least one vibration mode in the turbine blade;

the impacting structure is substantially spherical; and at least one diaphragm extends from an exterior surface of the impacting structure to the outer casing, the at least one diaphragm fluidly separating the first hemisphere and the second hemisphere.

15. The turbine blade of claim 14, wherein the internal vibration damping system further comprises a support grid, the support grid comprising at least one structural member, the at least one structural member coupling a first diaphragm of the at least one diaphragm of a first unit cell to a second diaphragm of the at least one diaphragm of a second unit cell, wherein the plurality of unit cells includes the first unit cell and the second unit cell.

16. The turbine blade of claim 15, wherein the at least one structural member is oriented substantially orthogonally to at least one of the first diaphragm and the second diaphragm.

17. The turbine blade of claim 14, wherein the at least one diaphragm at least partially comprises at least one nickel-based superalloy.

18. A turbine blade, comprising:

an internal vibration damping system disposed within the turbine blade, the internal vibration damping system comprising:

a plurality of unit cells, each unit cell of the plurality of unit cells comprising:

an impacting structure including at least one fluid passage disposed in the impacting structure;

a cavity encapsulating the impacting structure, the cavity comprising a first hemisphere and a second hemisphere, the cavity disposed within a substrate of the turbine blade, the substrate forming an outer casing of the cavity; and at least one fluid disposed in each of the first hemisphere and the second hemisphere between the impacting structure and the outer casing, wherein:

the internal vibration damping system dampens at least one vibration mode in the turbine blade;

the at least one fluid passage fluidly connects the first hemisphere and the second hemisphere; and movement of the at least one fluid through the at least one fluid passage causes viscous damping of the at least one vibration mode within the turbine blade.

19. The turbine blade of claim 18, wherein the at least one fluid passage further comprises multiple passages, and wherein:

a first passage of the multiple passages is disposed at a different distance from a center axis of the impacting structure than a second passage of the multiple passages; or the first passage of the multiple passages comprises a different internal flow area than the second passage of the multiple passages.

20. A turbine blade, comprising:

an internal vibration damping system disposed within the turbine blade, the internal vibration damping system comprising:

a plurality of unit cells, each unit cell of the plurality of unit cells comprising:

an impacting structure;

a cavity encapsulating the impacting structure, the cavity comprising a first hemisphere and a second hemisphere, the cavity disposed within a substrate of the turbine blade, the substrate forming an outer casing of the cavity;

at least one stopper disposed within at least one of the first hemisphere and the second hemisphere; and at least one fluid disposed in each of the first hemisphere and the second hemisphere between the impacting structure and the outer casing, wherein:

the at least one stopper is coupled to the outer casing and limits a range of motion of the impacting structure within the cavity; and the internal vibration damping system dampens at least one vibration mode in the turbine blade.

* * * * *